US008667882B1

(12) United States Patent
Larson et al.

(10) Patent No.: US 8,667,882 B1
(45) Date of Patent: Mar. 11, 2014

(54) FIREARM

(71) Applicant: Rock River Arms, Inc., Colona, IL (US)

(72) Inventors: Mark Larson, Colona, IL (US); Lester Larson, Jr., Colona, IL (US)

(73) Assignee: Rock River Arms, Inc., Colona, IL (US)

( * ) Notice: Subject to any disclaimer, the term of this patent is extended or adjusted under 35 U.S.C. 154(b) by 0 days.

(21) Appl. No.: 13/738,023

(22) Filed: Jan. 10, 2013

Related U.S. Application Data

(63) Continuation-in-part of application No. 13/102,331, filed on May 6, 2011, now Pat. No. 8,468,929.

(60) Provisional application No. 61/585,962, filed on Jan. 12, 2012.

(51) Int. Cl.
*F41A 5/18* (2006.01)
*F41A 19/33* (2006.01)
*F41A 19/46* (2006.01)

(52) U.S. Cl.
USPC ..... 89/193; 89/191.01; 89/140; 89/142

(58) Field of Classification Search
USPC ..... 89/132, 140, 149, 150, 154, 191.01, 89/191.02, 192, 193, 142; 42/16
See application file for complete search history.

(56) References Cited

U.S. PATENT DOCUMENTS

| | | | | | |
|---|---|---|---|---|---|
| 1,572,450 | A | | 2/1926 | Swebilius | |
| 3,776,095 | A | * | 12/1973 | Atchisson | 89/128 |
| 4,057,003 | A | * | 11/1977 | Atchisson | 89/138 |
| 4,058,922 | A | | 11/1977 | Elbe et al. | |
| 4,169,329 | A | * | 10/1979 | Atchisson | 42/16 |
| 4,326,353 | A | | 4/1982 | Ludwig et al. | |
| 4,521,985 | A | | 6/1985 | Smith et al. | |
| 4,579,034 | A | | 4/1986 | Holloway | |
| 4,615,134 | A | | 10/1986 | Beretta | |
| 4,709,496 | A | | 12/1987 | Johnson | |
| 5,519,954 | A | | 5/1996 | Garrett | |
| 5,588,241 | A | | 12/1996 | Hurley | |
| 6,293,040 | B1 | | 9/2001 | Luth | |
| 6,722,255 | B2 | | 4/2004 | Herring | |
| 7,219,462 | B2 | | 5/2007 | Finn | |
| 7,469,624 | B1 | | 12/2008 | Adams | |
| 7,798,045 | B1 | | 9/2010 | Fitzpatrick et al. | |
| 7,832,326 | B1 | | 11/2010 | Barrett | |
| 2004/0020094 | A1 | * | 2/2004 | Ealovega | 42/69.03 |
| 2006/0026883 | A1 | * | 2/2006 | Hochstrate et al. | 42/75.01 |
| 2006/0065112 | A1 | | 3/2006 | Kuczynko et al. | |
| 2007/0051236 | A1 | * | 3/2007 | Groves et al. | 89/142 |
| 2007/0199435 | A1 | | 8/2007 | Hochstrate et al. | |
| 2010/0000400 | A1 | | 1/2010 | Brown | |
| 2011/0315002 | A1 | * | 12/2011 | Keough | 89/128 |
| 2012/0180647 | A1 | | 7/2012 | Dublin | |
| 2012/0260793 | A1 | | 10/2012 | Gomez | |

* cited by examiner

*Primary Examiner* — Bret Hayes
(74) *Attorney, Agent, or Firm* — Banner & Witcoff, Ltd.

(57) ABSTRACT

A firearm having a gas piston system includes a bolt carrier, an adjustable gas piston block located forward on the firearm and an over-the-barrel spring and guide rod arrangement, all of which is housed and contained in a top rail that runs the length of the firearm and that maintains the alignment of these firearm components. The firearm further includes components that provide full auto firing capability. These components include a specially designed auto bracket that cooperates with a modified bolt carrier and a modified upper receiver.

24 Claims, 17 Drawing Sheets

FIREARM

CROSS REFERENCE TO RELATED APPLICATION

This Application is a continuation-in-part of U.S. application Ser. No. 13/102,331, filed May 6, 2011. This application also claims benefit to U.S. Provisional Application No. 61/585,962, filed Jan. 12, 2012. All of these applications are incorporated herein by reference.

FIELD

The present invention relates generally to firearms and more particularly to an improved firearm that utilizes a full auto firing system that may be incorporated with a direct or indirect gas impingement system.

BACKGROUND

Firearms having a direct gas impingement system or an indirect gas impingement system are known. Direct gas impingement is a type of gas operation for a firearm that directs gas from a fired cartridge directly to the bolt carrier or slide assembly to cycle the action in the firearm.

More specifically, in a direct gas impingement system, when the firearm is fired, the exhaust propellant gases from the fired cartridge are directed through a port at the end of the barrel and then channeled back to the bolt carrier and will strike, or impinge, the bolt carrier moving it rearward toward the buttstock and into a retracted position. The exhaust gases will then discharge out the ejection port on the side of the firearm near the buttstock. After discharge, the spring acting on the bolt carrier will move the bolt carrier back to the engaged position at the same time causing the bolt to pick up another cartridge from the magazine and move that cartridge into a battery position within the firearm's breech.

There are several known disadvantages with a direct gas impingement system. As an example, one disadvantage is that the breech of the firearm becomes fouled more quickly. This is caused by solids and impurities from the high-temperature gas from the fired cartridge condensing as they cool and being deposited on the bolt face and primary operating mechanism. Thorough and frequent cleaning is required to ensure reliability and proper operation of the firearm's operating mechanism. The amount of fouling depends upon the firearm's design as well as the type of propellant powder used in the fired cartridge. A further disadvantage is that combustion gases from the fired cartridge heat the bolt and bolt carrier as the firearm operates. This heating may alter the temper of metal parts, accelerating wear and decreasing the service life of the bolt, extractor, and extractor spring. Additionally, heat dries up the firearm's lubricant and makes the firearm's operating parts difficult to handle when clearing malfunctions. Heat can also melt the lacquer coatings of steel cartridge cases, gumming up parts. Moreover, thermal expansion in the firearm's action can result in loss of tolerances and consequent degradation in the firearm's accuracy.

Firearms having an indirect gas impingement system differ from the direct gas impingement system in that the exhaust gases do not directly act on the bolt carrier. Rather, the exhaust gases, after the firearm has been fired, act on and move a piston-type rod that, in turn, is operatively connected to the bolt carrier. The movement of the piston-type rod moves the bolt carrier rearward, or in the direction opposite to the fired bullet, and to a retracted position. Once the piston has traveled a certain distance, the remaining unused gas acting on the piston-type rod is discharged through a port on the firearm. A spring acting on the piston will then move the rod and accompanying bolt and bolt carrier forward, picking up a new cartridge, and moving that cartridge into the battery position.

It is also known that a firearm may be modified to provide full auto firing capability. To accomplish this, it is known to use a drop-in auto sear. When used, and when the operator pulls the trigger, the drop-in auto sear intercepts the hammer before the disconnector intercepts the hammer (i.e., bypasses the disconnector). The auto sear holds the hammer and functions like the disconnector until the bolt and bolt carrier move forward into the battery position. Typically, the bottom rear portion of the bolt carrier that extends down contacts the auto-sear which releases the hammer. The bolt and bolt carrier are fully back into battery position just before the hammer hits the firing pin, which causes the firearm to discharge a round. The cycle continues until the operator releases the trigger.

More specifically, in a normal, semi-automatic operation, the trigger's front acts as the sear. When the hammer is cocked there is a mating notch in the hammer that mates to the trigger's sear surface and they lock together. When the trigger is pulled the sear surface is rotated out of engagement with the hammer and spring tension causes the hammer to rotate and hit the firing pin which in turn strikes the cartridge. Some of the exhaust gasses discharged from firing are routed back through the firearm and push the bolt and bolt carrier backwards and consequently push the hammer down as the bolt and bolt carrier travel rearwards. This happens quickly so the trigger is still depressed at this time. As the hammer attempts to rotate back towards the bolt carrier as it closes, the disconnector catches the hammer to stop the hammer from rotating. As the trigger is released the disconnector disengages from the hammer which resets back onto the trigger. This completes the full cycle operation in semi-automatic mode.

In a full-automatic operation where an auto-sear is used in the firearm, the operator rotates the safety selector to full-auto mode which allows the trigger to move but not the disconnector. The same operation as stated above happens except at the point where the disconnector would normally catch the hammer. At this point the selector is depressing the tail of the disconnector so the disconnector is rotated out of the way. The result is the hammer continues rotating until it hits the auto-sear, which is normally out of the way because the carrier is pushing it rearwardly. The auto-sear then catches the hammer and restricts its movement. Then, as the bolt carrier returns and moves forward to the battery position to pick up another cartridge, the bolt carrier contacts the auto-sear's tail which rotates it out of the way, which thereby moves the auto-sear out of contact with the hammer. The hammer is then allowed to rotate and fire the firearm again. This operation cycle continues until the trigger is released and the trigger's sear surface catches the mating notch in the hammer.

SUMMARY

In an aspect of the present invention, a firearm having a gas piston system includes a bolt carrier, an adjustable gas piston block located forward on the firearm and an over-the-barrel spring and guide rod arrangement, all of which is housed in a top rail that runs the length of the firearm and that maintains the alignment of these firearm components. The firearm also includes an ambidextrous, non-reciprocating charging handle located forward on the firearm and positioned within the top rail for charging the firearm. With the present invention, no buffer assembly is required, allowing for the mounting on the firearm of a side-folding stock of many different configurations. The invention improves upon the known indirect impingement systems in a number of ways, as explained below and illustrated in the drawings.

In another aspect of the invention, the firearm may include full auto firing capability. In this embodiment, the firearm may be equipped with a specially designed auto bracket, a modified upper receiver, and a modified bolt carrier that cooperate together to provide full auto capability. These firearm components may be used with the gas piston system of the invention, described herein, or with other firearm styles, including direct gas impingement systems.

In one embodiment, the firearm may include a lower receiver, an upper receiver mounted to the lower receiver, a barrel mounted to the upper receiver, a handguard surrounding at least part of the barrel, an elongated mounting rail positioned above the upper receiver, a gas piston housing mounted to the elongated rail and positioned forward of the upper receiver, a piston and rod assembly operatively mounted to the gas piston housing and above the barrel, the piston and rod assembly operatively connected to a bolt carrier disposed in the upper receiver, a trigger assembly that includes a trigger and a hammer, an auto sear that operatively contacts the hammer, and an auto bracket slidably mounted to the upper receiver and to the bolt carrier, the auto bracket defining an opening for receiving the auto sear and causing the firearm to operate in full auto firing mode.

DESCRIPTION OF DRAWINGS

The present invention is illustrated by way of example and not limited in the accompanying figures in which like reference numerals indicate similar elements and in which.

DESCRIPTION OF THE EMBODIMENTS

Figure 1:
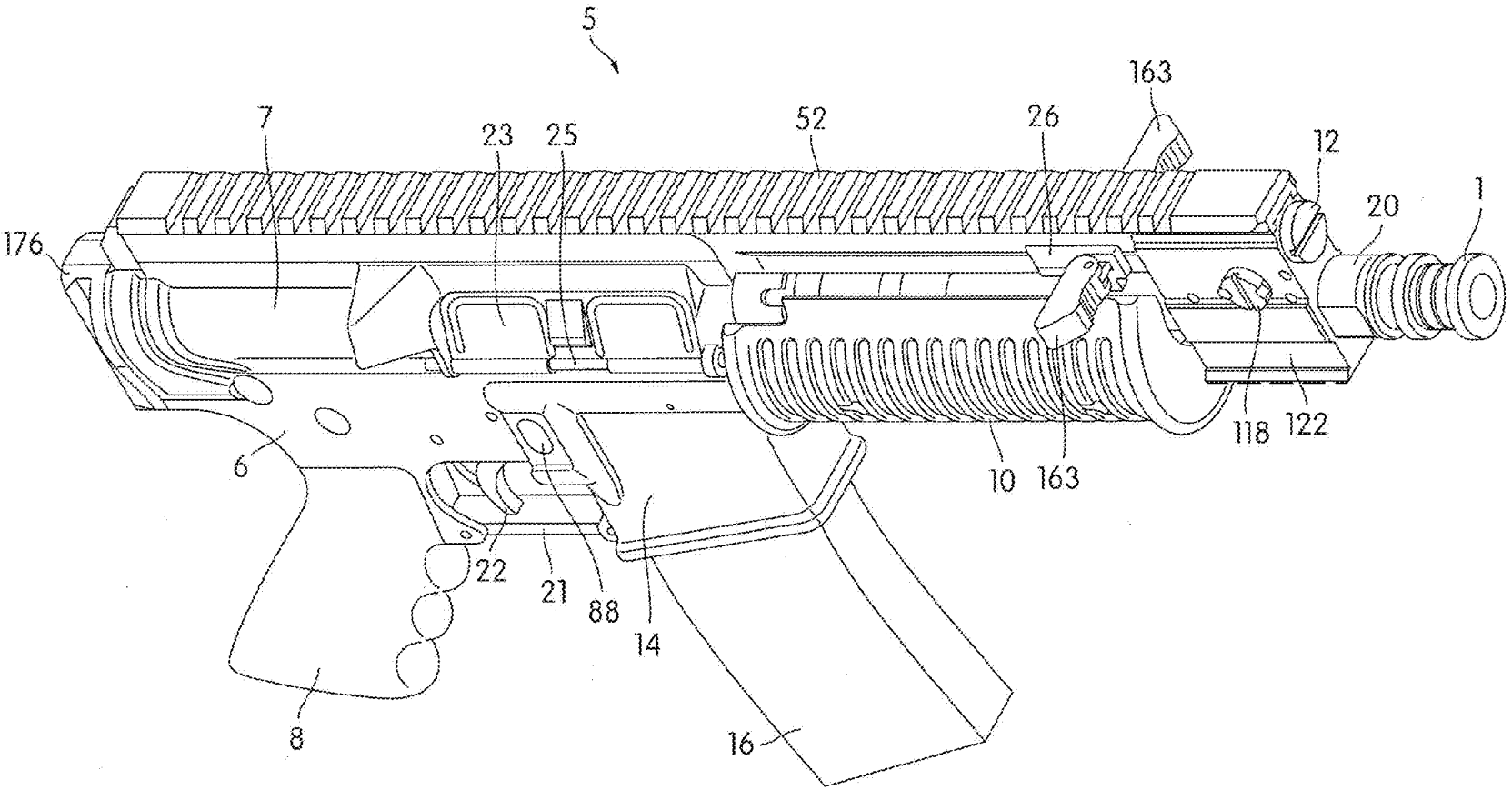
FIG. 1 illustrates an isometric view of an exemplary firearm for use with the teachings of the invention.

Referring to the drawings, where like numerals indicate like elements, the firearm 5 of the invention includes an adjustable performance gas piston system located forward on the firearm in front of the handguard and away from the operator, a purpose-designed bolt carrier, and an over-the-barrel spring and guide rod arrangement, all of which is housed and held in position by a top rail that runs the length of the firearm and that maintains the alignment of these firearm components. A hard polymer handguard is used to protect the operator's hands during operation of the firearm.

With the firearm 5, the traditional direct impingement system is completely eliminated and the problems associated therewith. Additionally, the absence of the traditional direct impingement operating system means that no buffer assembly is required, allowing for the mounting of a side-folding stock of many different configurations. For the pistol version of the firearm this means a clean, pistol-like profile without the naked buffer tube extending out the back of the pistol. An added benefit of the invention is that the design of the upper receiver and guide rod base prevents gas blow-by to the back of the receiver and to the operator's face.

The firearm of the invention may be in the form of a pistol, carbine or a rifle, and the performance piston driven system of the invention may be incorporated into any of these forms of firearms. The firearm of the invention will work for various calibers such as .223, .243, 5.56 mm, 9 mm, .308, .40, and others. The gas piston system of the invention will work with any standard AR-style receiver and other firearm platforms.

Additional aspects of the firearm 5 include a piston system that will direct the discharged gases in front of the front handguard system and through a specially designed gas piston regulator housing block and not to the back of the firearm. Further, the firearm of the invention uses an ambidextrous, non-reciprocating charging handle mounted at the forward end of the firearm and in the top rail, the handle having foldable ears which may be used singly or in unison to charge the firearm. The handguard mounting system, as more fully explained below, is more rigid and easier to change out than traditional handguards and eliminates the delta or handguard slip ring. The handguard may be changed out to use a handguard system having one or more mounting rails.

The use of the adjustable gas system allows for adjustment of different ammunition and climate changes. The gas regulator used with the system may be a two position regulator. The slide-in top rail extending the length of the firearm serves as a guide to hold and a means to align the bolt carrier, the piston gas regulator housing and the piston rod assembly. Additionally, the mounting rail which not only aligns the various components of the firearm also may be used to mount lights, lasers, optics and other accessories. Moreover, the mounting rail is also the guide for the charge handle which is located at the forward end of the firearm. The firearm also uses a rear mounting rail that may be mounted on the rear receiver adapter and that may be used to mount a sling mount. For the carbine or rifle version of the firearm, a foldable stock may be mounted to the rear receiver adapter or to the rear of the receiver. Also, the gas regulator housing may include a mounting rail on one of its sides to mount a sling mount, weapon lights or other accessories. These unique aspects, among others, of the invention are further described below and illustrated in the drawings.

Figure 7:
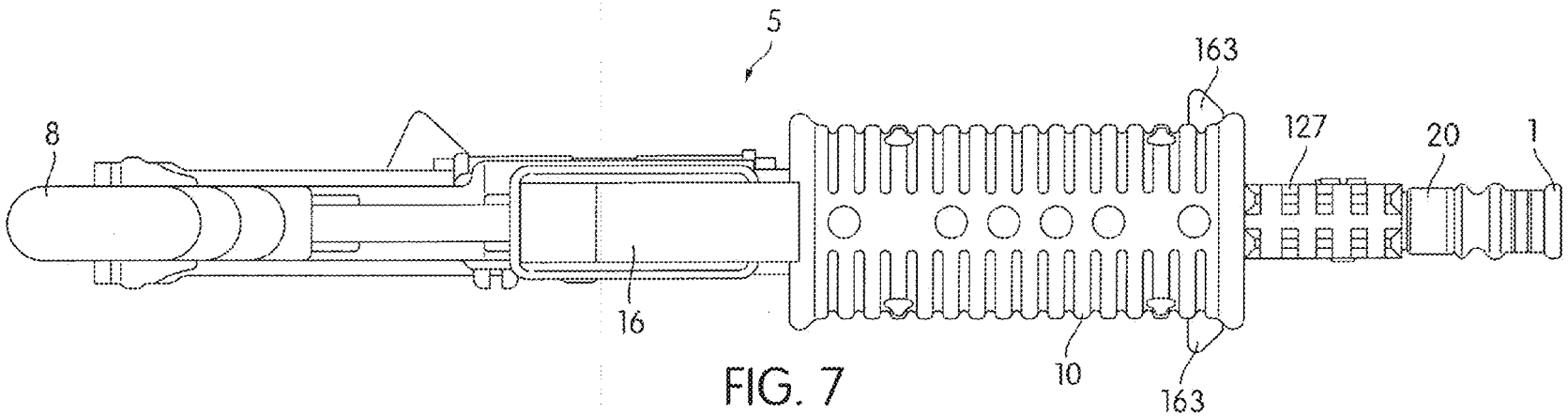
FIG. 7 illustrates a bottom view of the firearm of FIG. 1.
Figure 8:
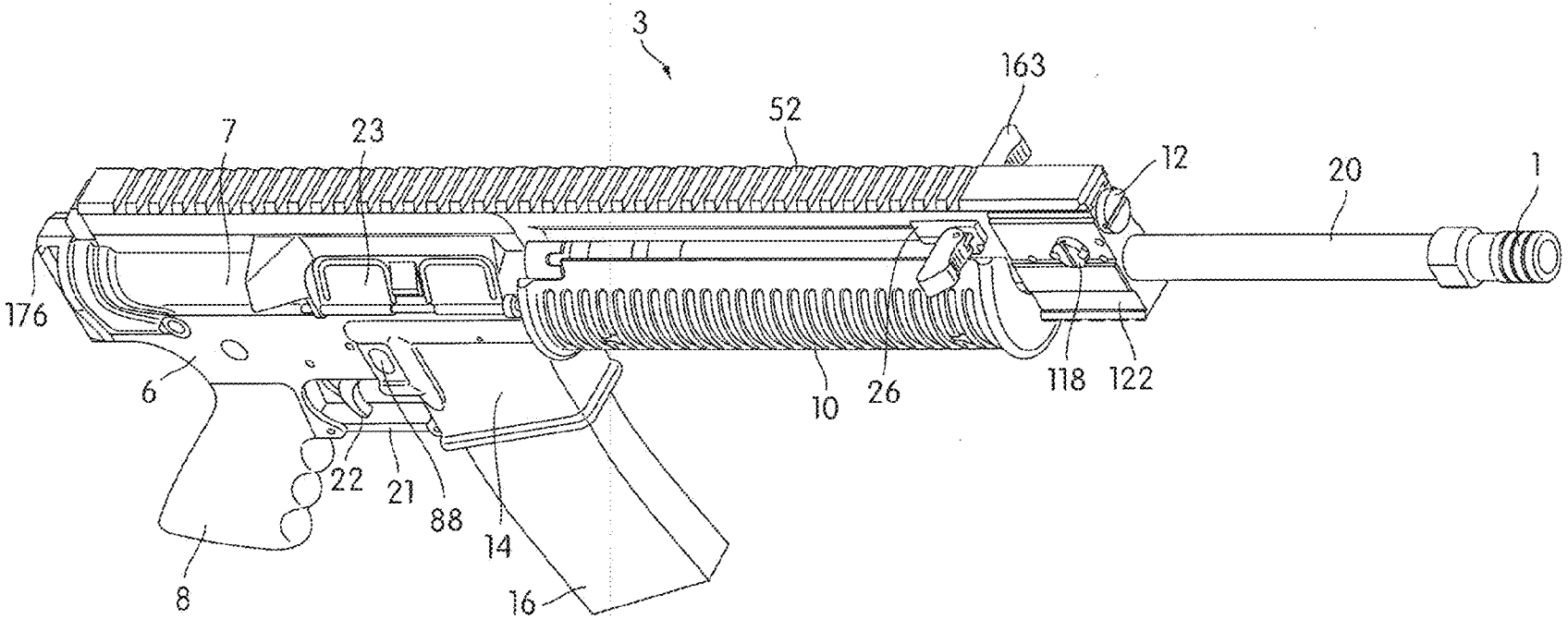
FIG. 8 illustrates an isometric view of an alternative exemplary firearm for use with the teachings of the invention.
Figure 9:
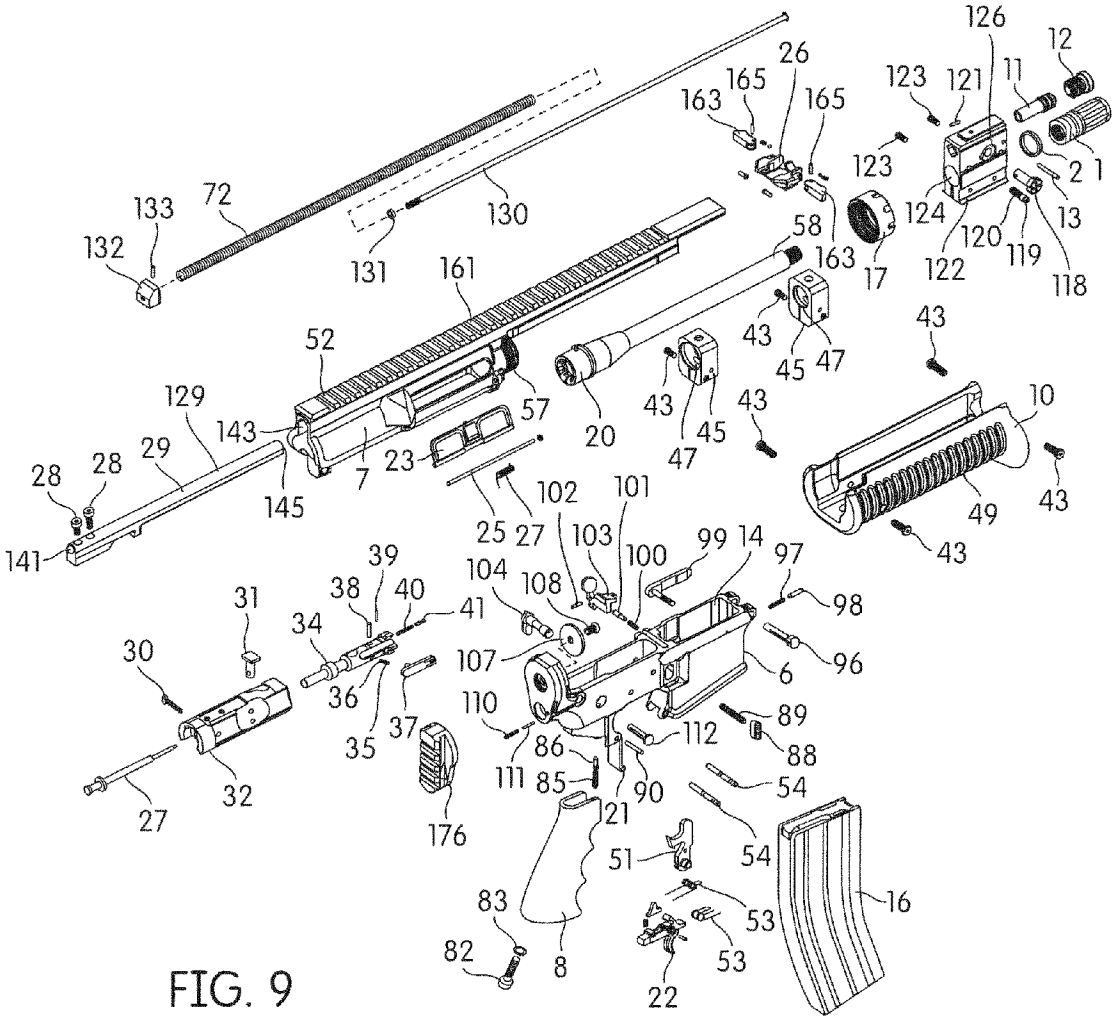
FIG. 9 illustrates an exploded view of the components of the firearm of FIG. 1.
Figure 11:
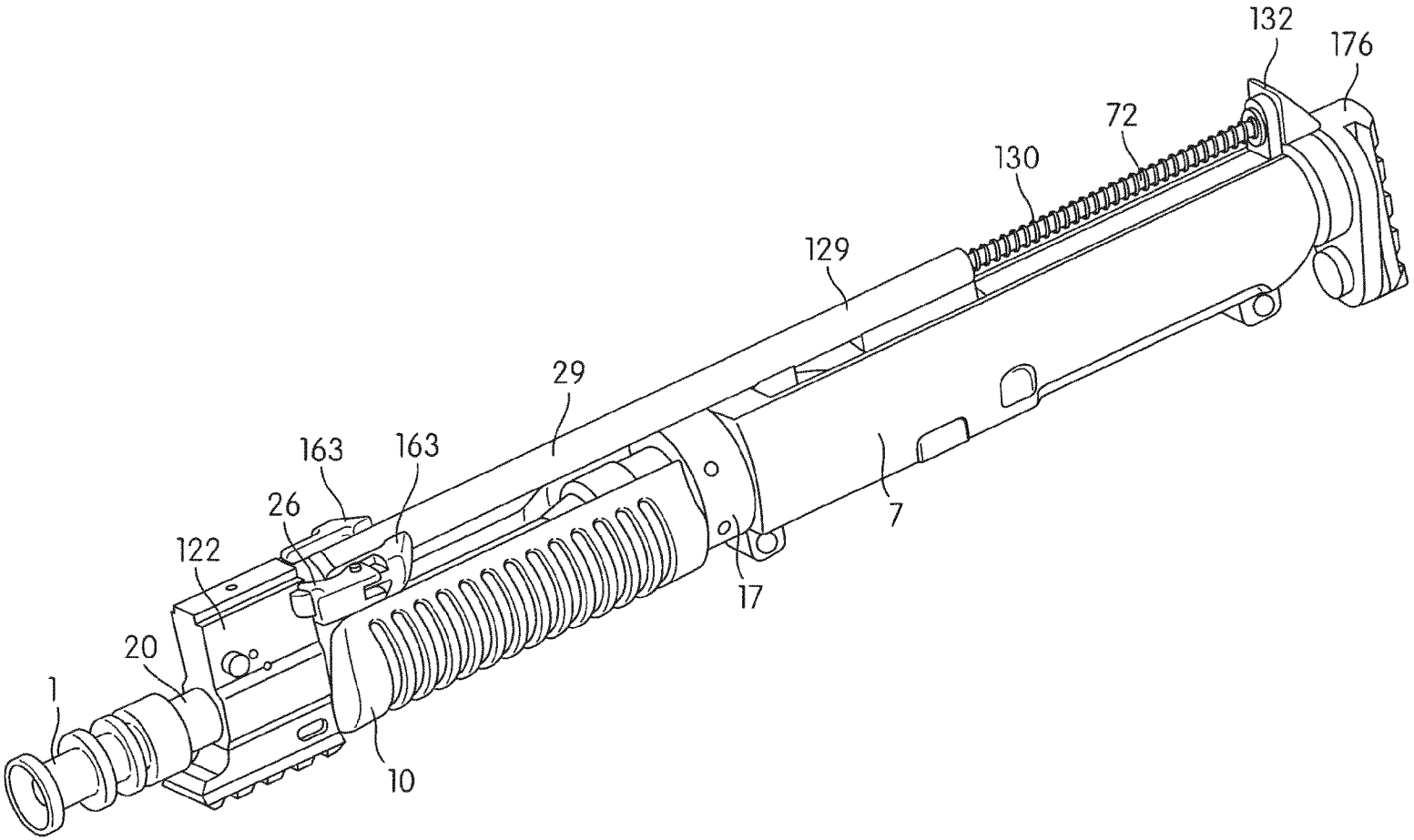
FIG. 11 illustrates an isometric view of a partial firearm of FIG. 1 with the top mounting rail removed.

Referring to FIGS. 1-9 and 11, FIG. 1 illustrates an isometric view of pistol version of a firearm 5 of the invention, and FIGS. 2-7 illustrate various views of the firearm 5 of FIG. 1. FIG. 8 illustrates a carbine version of the firearm 5 of the invention. The primary difference between the carbine version and the pistol version is the length of the barrel, handguard and top rail. FIG. 9 illustrates an exploded view of the various components of the firearm 5. FIG. 11 illustrates a partial view of the firearm 5 with the top mounting rail removed.

As depicted in FIGS. 1-9 and 11, the firearm 5 generally includes a lower receiver 6, an upper receiver 7 mounted to the lower receiver, a pistol hand grip 8 mounted to the lower receiver, a handguard 10 mounted around a barrel 20, a magazine well 14 formed in the lower receiver for receiving a magazine 16 that contains live rounds or cartridges, not shown. The firearm 5 also includes a trigger 22 and a trigger guard 21 that is pinned to the lower receiver and located between the magazine well 14 and the hand grip 8. In an exemplary embodiment, the trigger may be a two-stage trigger. As known in the art, the magazine 16 is released from the magazine well 16 upon pressing the magazine button 88. The upper receiver defines an ejector port that is covered by an ejector port flap 23 that is held to the upper receiver though an ejector flap pin 25 and spring 27.

Referring to FIGS. 9 and 11, the lower receiver 6 includes a safety selector 104 for providing a safe and fire mode for the firearm. The selector may also provide for a semi-automatic mode and a full-automatic mode. The safety selector is held to the receiver by a safety detent 86 and safety detent spring 85. The lower receiver also includes a rebound buffer 107 that is mounted to the inside end of the receiver through the use of a buffer screw 108. The lower receiver 6 also includes the trigger guard 21 that is pinned to the receiver through the use of a pin 90. Pivot pin 96 and takedown pin 112 extend through openings in the side of the lower receiver to mount the lower receiver 6 to the upper receiver 7. Pivot pin spring 97, pivot pin detent 98, takedown pin spring 110 and takedown pin detent 111 may be used to hold the respective pins 96 and 112 to the lower receiver.

The lower receiver 6 also includes magazine catch and release components, including the magazine release button 88, magazine catch spring 89 and magazine catch 99. The magazine catch and release components are used to hold the magazine 16 in the magazine well 14 and to release the magazine from the well upon pressing the magazine release button 88. Various magazines may be used with the firearm. Moreover, the lower receiver includes a bolt catch 103, bolt catch plunger 101, bolt catch spring 100 and bolt catch roll pin 102. Mounted to the lower receiver is the pistol grip 8 which is secured to the lower receiver through the use of a pistol grip screw 82 and washer 83. In an exemplary embodiment, the pistol grip may be a Hogue rubber pistol grip. Mounted to the back of the lower receiver is a sling adapter base 176 on which may be mounted a sling adapter, not shown. The receiver includes the trigger 22, hammer 51, springs 53 and mounting pins 54 that are used to fire the firearm.

The handguard 10 is mounted around the barrel 20 and is secured via screws 43 to front and rear handguard brackets 45. The barrel 20 is mounted through openings 47 formed in the brackets 45. The handguard 10 may be made of a hard polymer and may wrap at least partially around the barrel and may define a plurality of ribs 49 which serve as a handgrip to assist the operator in handling the firearm. Alternatively, the handguard 10 may define one or more rails that surround the barrel and on which may be mounted firearm accessories, including lights and optics. Other handguard configurations are possible with the invention. The handguard protects the operator's hand from the heat generated from the barrel after the firearm is fired.

The barrel 20 is mounted at one end to the upper receiver 7 through the use of a barrel nut 17 which threads onto a threaded end 57 of the upper receiver. At the other end, the barrel passes through a gas piston housing 122 and threadably connects to an optional flash hider 1. A crush washer 2 may be positioned between the flash hider 1 and the threaded end of the barrel. The barrel 20 may include one or more ports 58 in the barrel wall that permit discharged gases to escape and pass into the gas piston housing 122.

The gas piston system of the invention includes the gas piston housing 122 that defines generally a rectangular configuration and is slidably mounted to the top rail 52. The gas piston housing may be slidably mounted at its top wall to the top rail 52 through a tongue and groove configuration, a dovetail configuration, or other techniques. Alternatively, the gas piston housing may be fixedly mounted to the top rail 52 through the use of fasteners or the like. The gas piston housing 122 defines an opening 124 for receiving the barrel 20 and for permitting the barrel to pass therethrough. The gas piston housing 122 also includes a side opening 126 positioned above the opening 124 for receiving a gas regulator 118 that may be used to control the amount of gas passing through the gas piston system. A gas regulator detent 119, spring 120 and locking pin 121 may be used to hold the gas regulator 118 within the housing 122. The gas regulator 118 may be a two position regulator and may be adjusted manually by turning the regulator within the housing through the use of a screwdriver or similar tool. The gas regulator is adjustable so the operator can adjust the gas flow through the gas piston housing for semi-automatic or full-automatic use and for various types of ammunition, which have different pressures which can cause what is known as short stroke or excessive pressure concerns within the gas piston housing.

Figure 2:
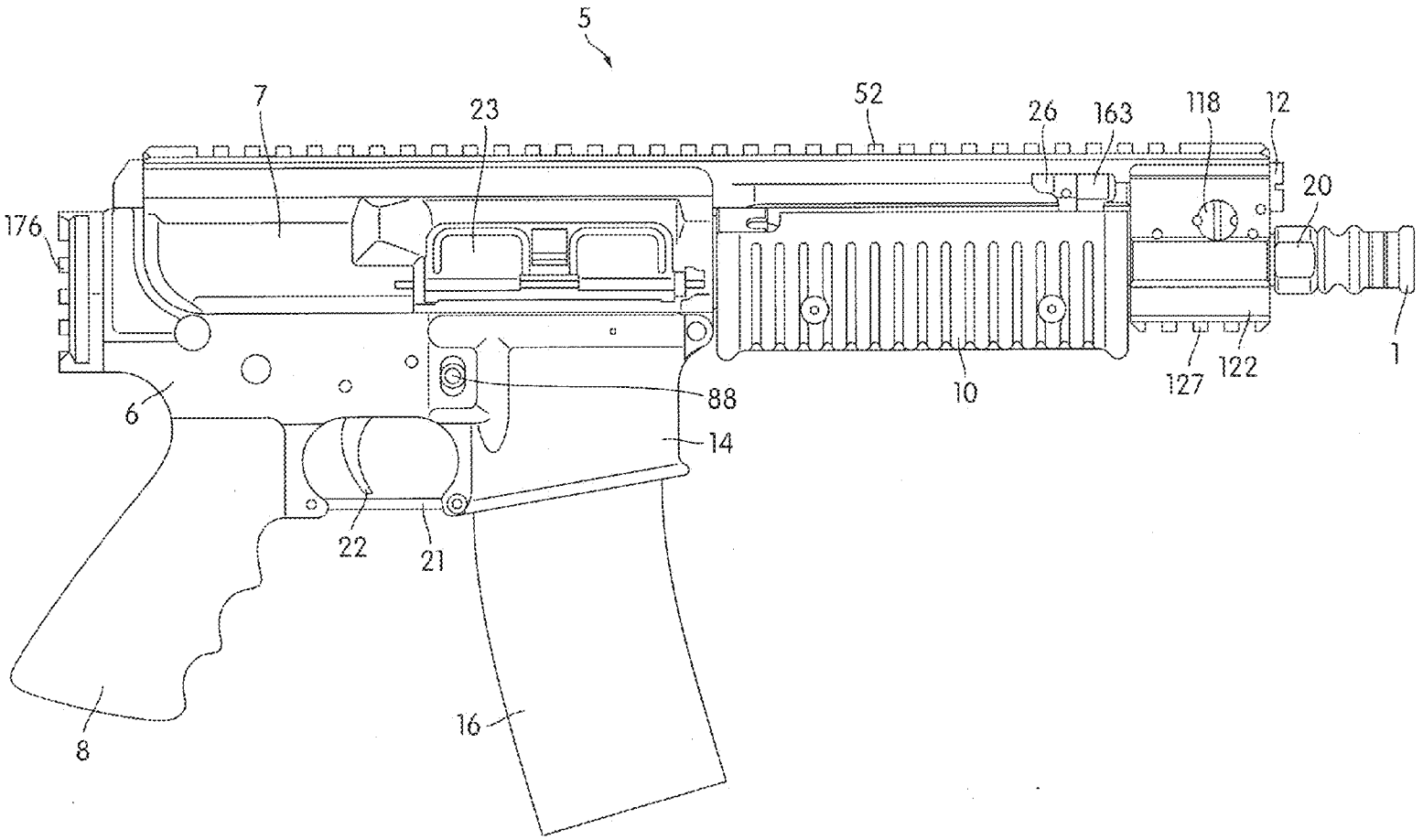
FIG. 2 illustrates a side elevation view of the firearm of FIG. 1.
Figure 3:
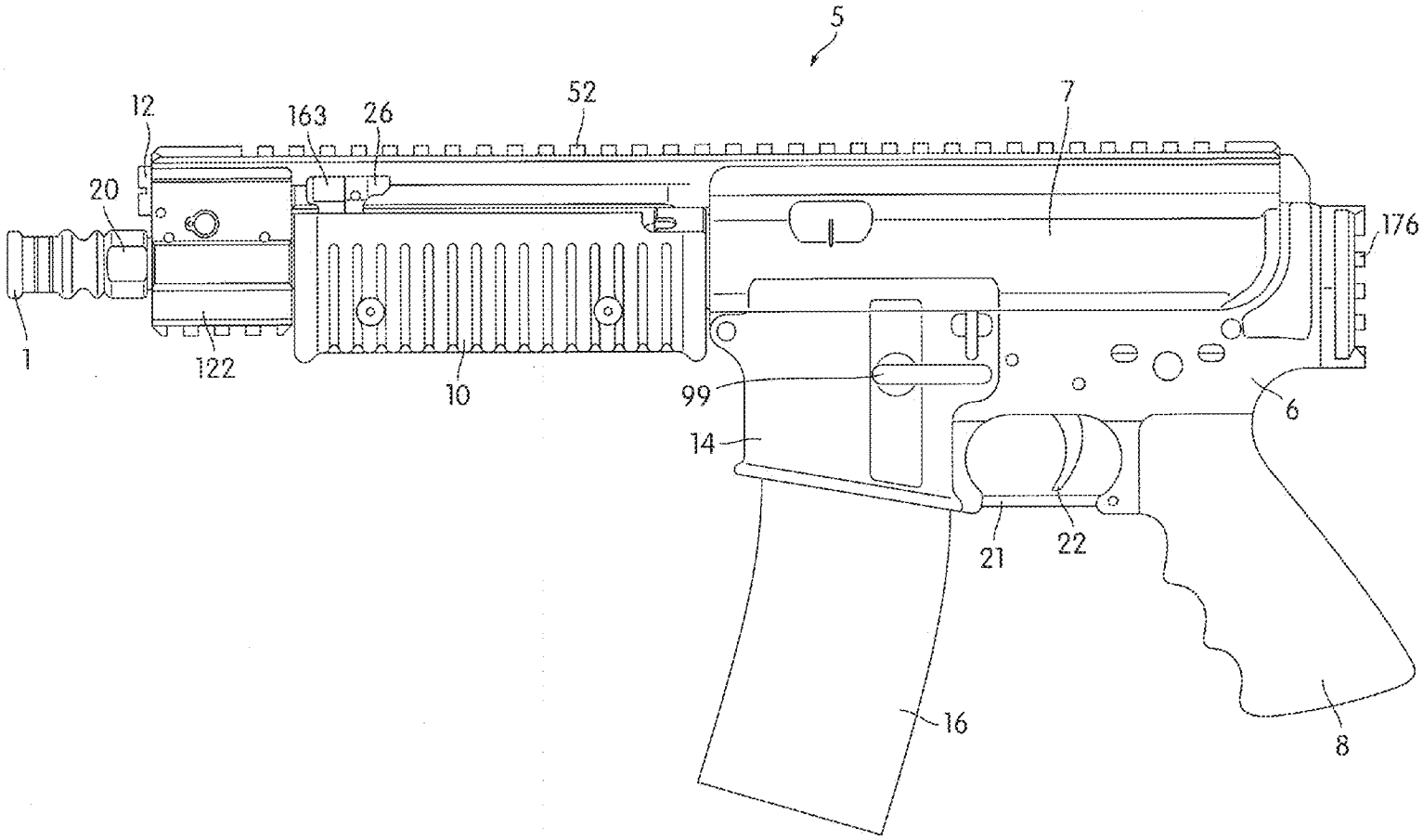
FIG. 3 illustrates another side elevation view of the firearm of FIG. 1.
Figure 4:
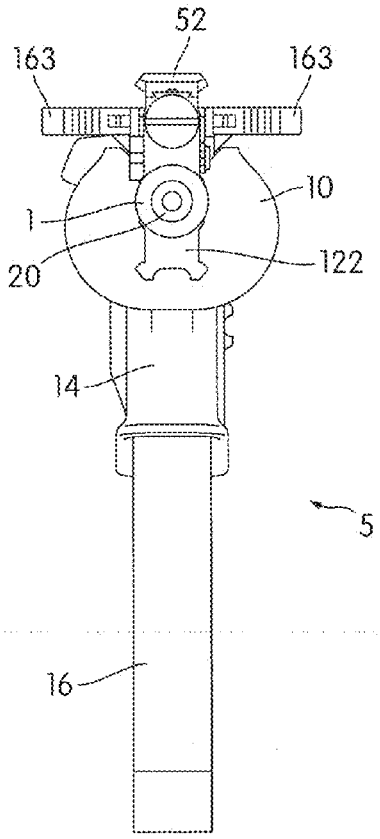
FIG. 4 illustrates an end elevation view of the firearm of FIG. 1.
Figure 5:
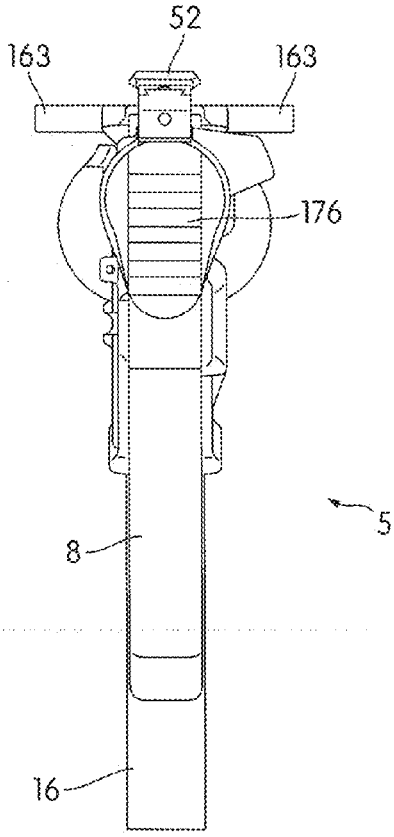
FIG. 5 illustrates another end elevation view of the firearm of FIG. 1.
Figure 6:
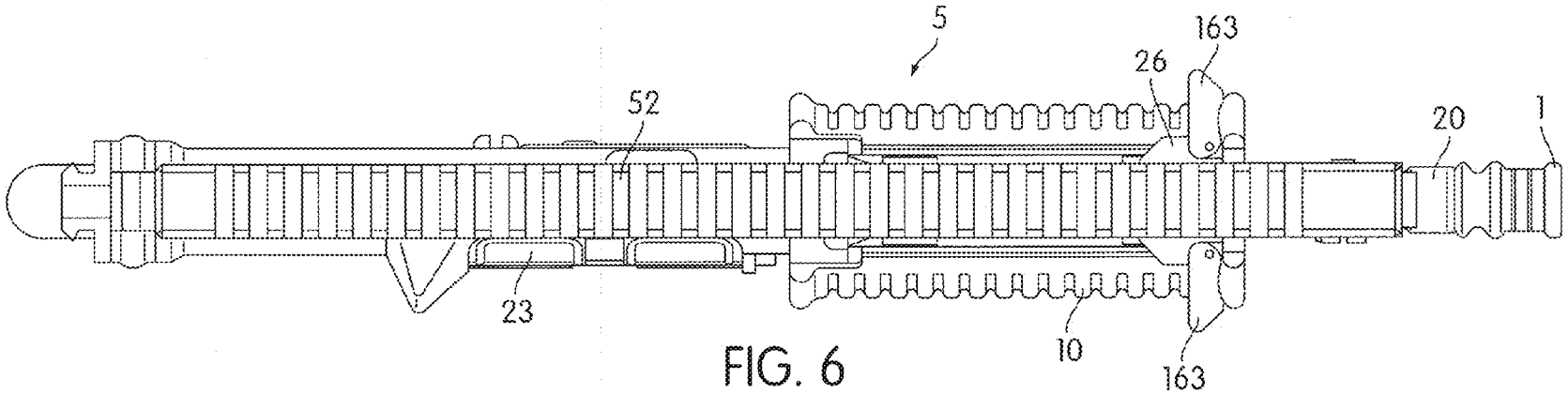
FIG. 6 illustrates a top view of the firearm of FIG. 1.

The gas piston housing 122 is configured to receive a piston 11 that is operatively connected to a guide rod 130 to form a piston-rod assembly. The piston 11 is cylindrical in shape and will move within the housing 122 when exhaust gases from a fired cartridge pass through the barrel port 58 into the housing 122 and act on the head of the piston 11. The piston 11 will in turn drive the operatively connected rod 130 toward the rear of the firearm. A piston housing plug screw 12 is positioned at an end of the piston housing and may be held in position by a roll pin 13. Gas piston housing screws 123 may be mounted through a side of the piston housing 122. As shown in FIGS. 2 and 7, the gas piston housing 122 may include one or more rails 127 on one or more sides of the piston housing on which to mount accessories, such as lights and optics.

The guide rod 130 is operatively connected at one end to the piston 11 and is further connected at the other end to a guide rod base 132. A guide rod washer 131 and guide rod roll pin 133 may be used to hold the guide rod base 132 onto the guide rod. A coiled, action spring 72 is positioned around the guide rod along the majority of the length of the rod. The spring 72 opposes the forces exerted by the piston 11 during cycling of the firearm. Operatively connected to the guide rod base 132 is an operating rod housing 29. The rod housing 29 defines an elongated tube 129 with a through passageway 141 that receives the rod 130 and spring 72 and mounts to the bolt carrier 32 through the use of housing screws 28. The elongated tub 129 defines an exterior surface that is shaped to match an interior channel 143 formed in the upper receiver 7. The elongated tube 129 defines an end 145 that serves as the striking point for the gas piston 11 during operation of the firearm.

The upper receiver 7 slidably-mounts to the elongated top rail 52 that extends the length of the upper receiver and beyond. The elongated top rail 52 houses and aligns the numerous components of the firearm, including the gas piston housing 122, the handguard brackets 45, the bolt carrier housing 32, the operating rod housing 29 and guide rod 130. With this configuration, the primary action components of the firearm will be more accurately aligned to improve the performance of the firearm. The rail 52 may define a top surface that may be used to mount numerous accessories to the firearm, including lights and optics. Any of the rails used with the firearm 5 may be tactical rails and may comprise a series of ridges 161 with a T-shaped cross-section interspersed with flat spacing slots. Optics, for example, are mounted either by sliding them on from one end of the rail or the other, by means of a "rail-grabber" which is clamped to the rail with bolts, thumbscrews or levers, or onto the slots between the raised sections.

Slidably mounted to the underside of the rail 52 is a charging handle assembly 26 that may include a pair of opposing ears 163 that can be operated by either hand to charge the firearm. The charging handle assembly will mount to a channel formed in the underside of the rail and will slide along the underside of the rail. Unlike traditional charging handles, the charging handle 26 is located forward on the firearm. The opposing ears 163 may be pinned, through the use of pins 165, and folded against the side of the firearm when not in use. The opposing ears permit ambidextrous use of the charging handle. The forward located charging handle 26 is non-reciprocating. The charging handle is not affixed to the operating rod so the charging handle does not run back and forth when the firearm cycles. In other words, in the exemplary embodiment, the charging handle does not serve as a forward assist to the bolt carrier.

The firearm 5 also includes the bolt 34 and bolt carrier 32. The bolt includes an extractor 37, extractor pin 38, extractor spring 35 and spring insert 36. Also included on the bolt are an ejector 41, ejector spring 40 and ejector roll pin 39. The bolt carrier includes a cam pin 31. Positioned within the bolt 34 is a firing pin 27 that is held in position by a firing pin retaining pin 30. The bolt carrier is configured to be shorter than a standard bolt carrier without the forward assist notches. The bolt carrier may include two dovetail cuts in the top of the bolt carrier to relieve the stresses off of the key screws so as to prevent the key screws from shearing off during use. Additionally, the bolt carrier tail diameter has been increased. By increasing the bolt carrier tail diameter and installing the dovetail in the top of the carrier there is a reduced chance of shearing of the key screws.

In operation, the operator can handle the firearm 5 by grasping the handguard 10 in one hand while holding the pistol grip 8 in the other hand. The bolt assembly strips a cartridge from the magazine and moves the cartridge forward into the barrel as the bolt assembly moves toward a battery position. Once the bolt assembly is in the battery position, the operator can activate the trigger. The trigger releases the cocked hammer and the hammer strikes the firing pin, as known in the art. The firing pin moves forward and makes contact with the cartridge. The contact between the firing pin and the cartridge causes the cartridge to fire and the resultant explosion forces a bullet out the end of the barrel along a forward path and in the direction the barrel is pointing. The resultant explosion also causes the bolt assembly to recoil in a backward direction opposite of the direction of bullet travel. This is accomplished through the piston driven system of the invention which includes the elongated rod that is operatively connected to the bolt assembly. The exhaust gases from the fired cartridge travel through an opening in the barrel and into the piston housing and in contact with the piston head of the piston-rod assembly, located above the barrel. The piston-rod assembly will drive the operatively connected bolt assembly in the direction away from the direction of the fired bullet. The movement of the bolt assembly in turn allows the spent cartridge to be ejected. Once the piston has traveled a certain distance, the remaining unused gases acting on the piston is discharged through the piston housing. The coiled spring around the piston rod will oppose the backward travel of the bolt assembly and will move the rod assembly and bolt assembly forward so that another cartridge can be stripped from the magazine and the bolt assembly can be returned to the battery position.

Figure 10:
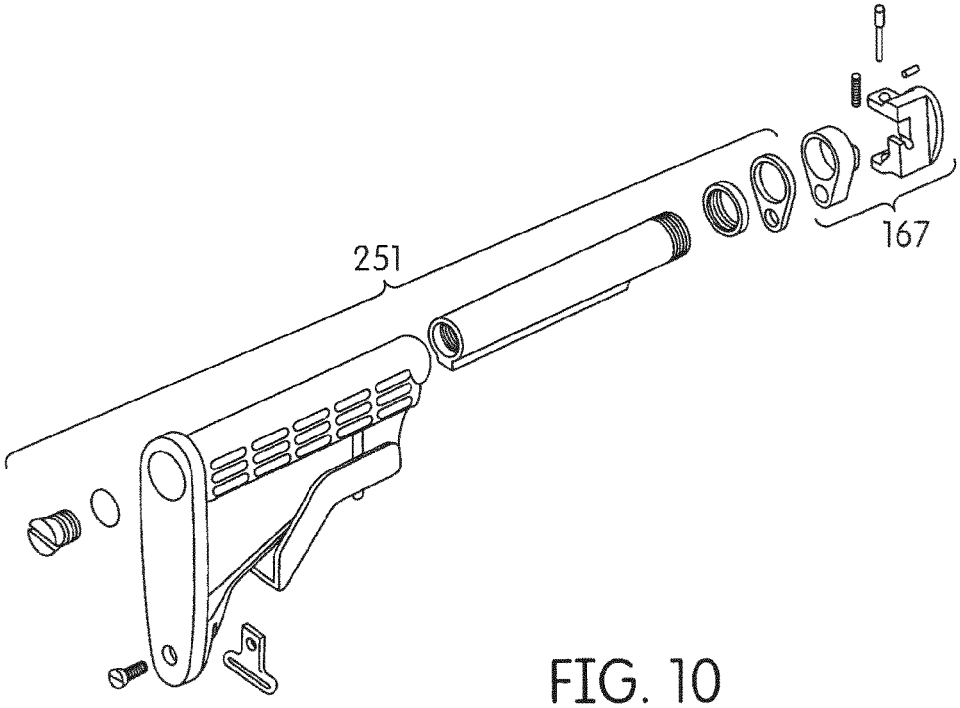
FIG. 10 illustrates an exploded view of an exemplary foldable stock that may be mounted to the firearm of FIG. 8.

Referring to FIG. 8, there is depicted an alternative exemplary firearm 3 that is in the configuration of a carbine. The firearm 3 includes mostly the same components of firearm 5. The firearm 3 includes a longer barrel 20, handguard 10 and rail 52. As depicted in FIG. 10, an optional foldable stock 251 may be mounted to an end of the lower receiver. The foldable stock may define numerous configurations and may define means for mounting sling adapters and other accessories. A hinge assembly 167 may be used to mount the foldable stock to the lower receiver.

Referring to FIGS. 12-25, in another aspect of the invention, the firearm 5 may be modified to provide full automatic firing capability. In this embodiment, and as shown in the figures, the firearm 5 may be equipped with an auto bracket 500, a modified upper receiver 502 and modified bolt carrier 504. These firearm components may be used with a pistol, carbine or rifle style firearm and may be used with either a direct or indirect gas impingement system. Additionally, the embodiment may be used in an AR-style firearm with a shortened bolt carrier or any other firearms with shortened systems that utilize over the top recoil systems. The components of this embodiment may also be used with a drop-in auto sear.

Figure 12:
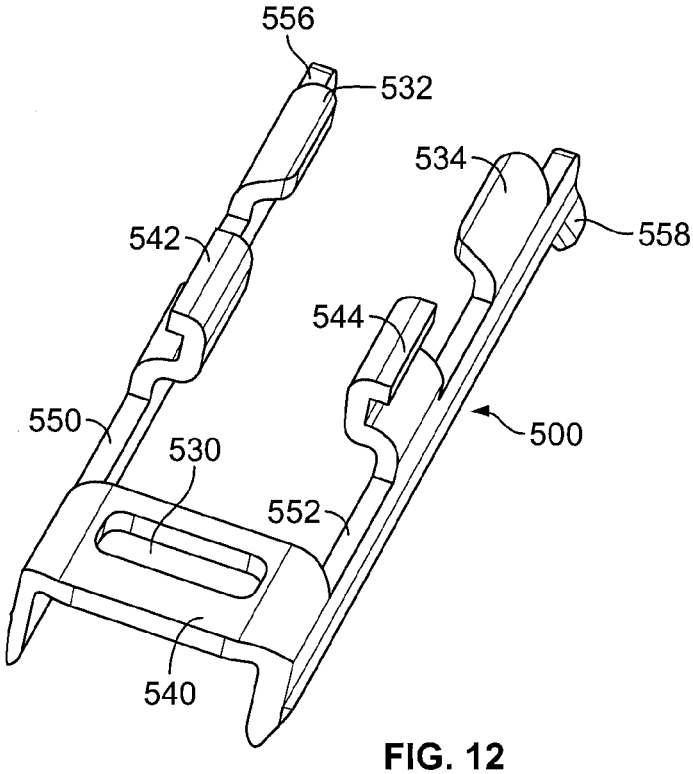
FIG. 12 illustrates an isometric view of an exemplary auto bracket that will permit the firearm of FIG. 1 to operate with full auto firing capability.
Figure 13:
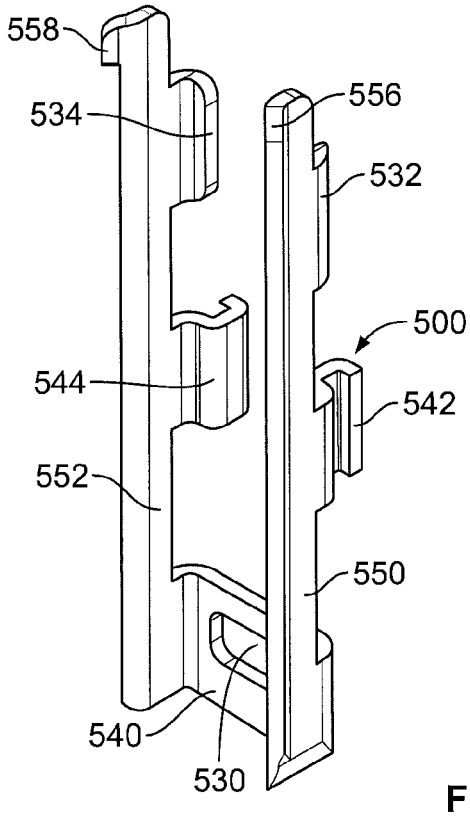
FIG. 13 illustrates another isometric view of the auto bracket of FIG. 12.
Figure 14:
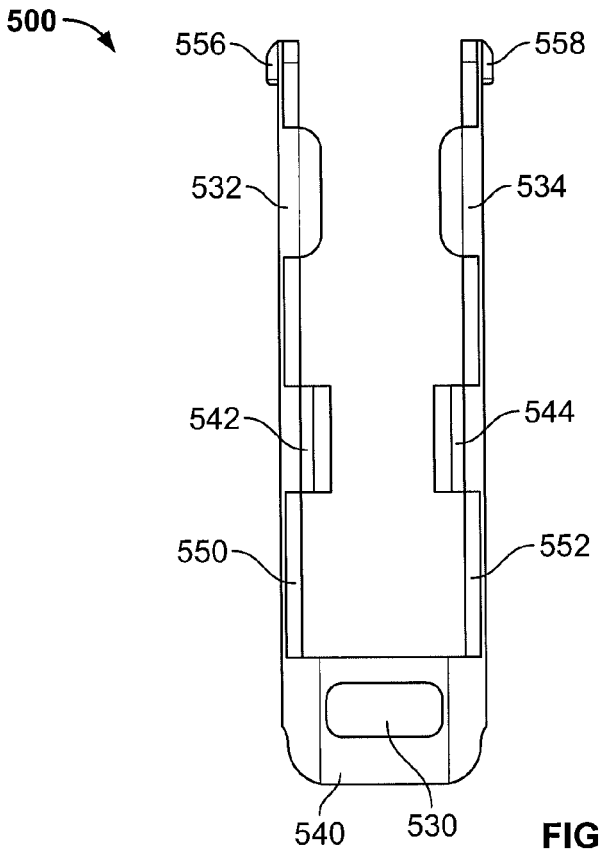
FIG. 14 illustrates a bottom view of the auto bracket of FIG. 12.

Referring to FIGS. 12-14, the auto bracket 500 has the appearance of a sled and defines a pair of opposing rails 550, 552 that are joined together by a support bracket 540. The support bracket includes an elongated slot 530 that is configured to receive an auto sear 580, described below. Extending from the rails 550, 552 are a pair of curve-shaped opposing guides 532, 534 that extend toward each other, and a pair of opposing guides 542, 544 that extend away from each other and that also have curved ends. The guides 532, 534, 542, and 544 cooperate with grooves 510 formed in the upper receiver 502, shown in FIG. 19. The guides, which define curved guide ends, align and mate the auto bracket 500 with the upper receiver 502 and permit the auto bracket to slide relative to the upper receiver, as explained below. The guides 532, 534, 542, 544 may define one or more pairs of guides and may define numerous configurations that permit the mounting of the auto bracket to the upper receiver and that permit the slidable movement of the upper receiver relative to the auto bracket. As used herein, the term guide or guides is to be understood to mean any extension, protrusion or portion of the auto bracket that extends therefrom, or forms a part thereof, and is used to operatively connect the auto bracket to the upper receiver or bolt carrier.

The support bracket 540 which extends between the opposing rails 550, 552 provides structural support to the rails 550, 552. The elongated slot 530 is formed in the support bracket 540 and extends in a direction between the rails 550, 552. In other words, the elongated slot is elongated in a direction transverse to the longitudinal length of the rails 550, 552. The elongated slot 530 is configured to operatively connect to the auto sear. As depicted, the rail 550 is configured with the guides 532 and 542, while the rail 552 is configured with guides 534 and 544.

The rail 550 defines at one end a stop guide 556 and rail 552 defines at one end a stop guide 558. The stop guides 556 and 558 are configured to operatively engage with and slide along the slots or grooves 514, 516 formed in the bolt carrier 504. The stop guides 556 and 558 function to stop the auto bracket relative to the bolt carrier 504, as explained below.

As used herein, the term auto bracket is meant to broadly include any slidable structure defining the exemplary configuration or other functionally similar configuration, cooperating between the upper receiver and bolt carrier, and operatively connecting to an auto sear and/or auto cuts made in the lower receiver, to permit the firearm to operate in a full auto mode. The auto bracket is also broadly understood to operate with piston driven systems as well as direct gas impingement systems.

Figure 15:
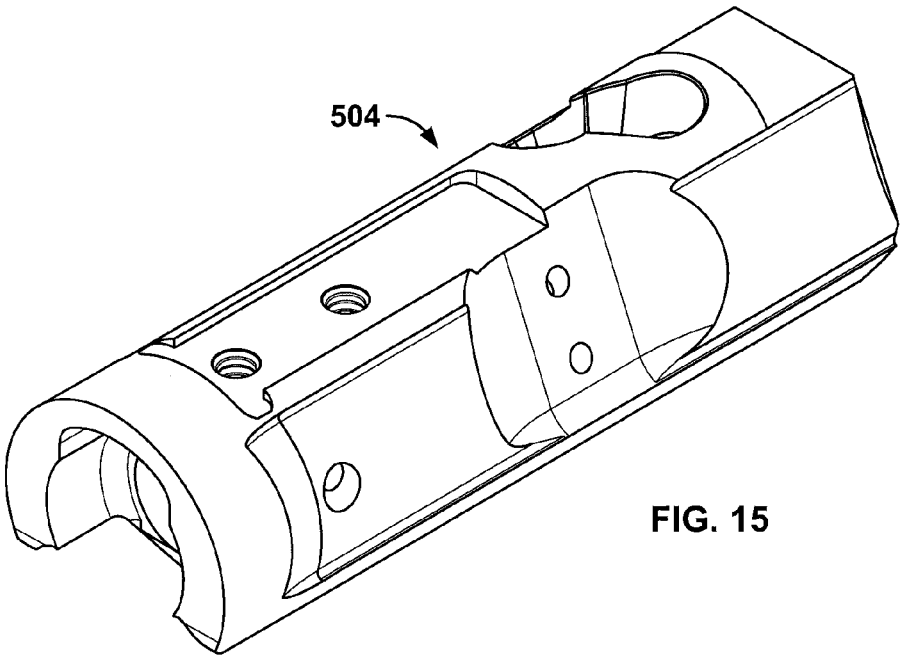
FIG. 15 illustrates an isometric view of an exemplary bolt carrier that may be used with the auto bracket of FIG. 12.
Figure 16:
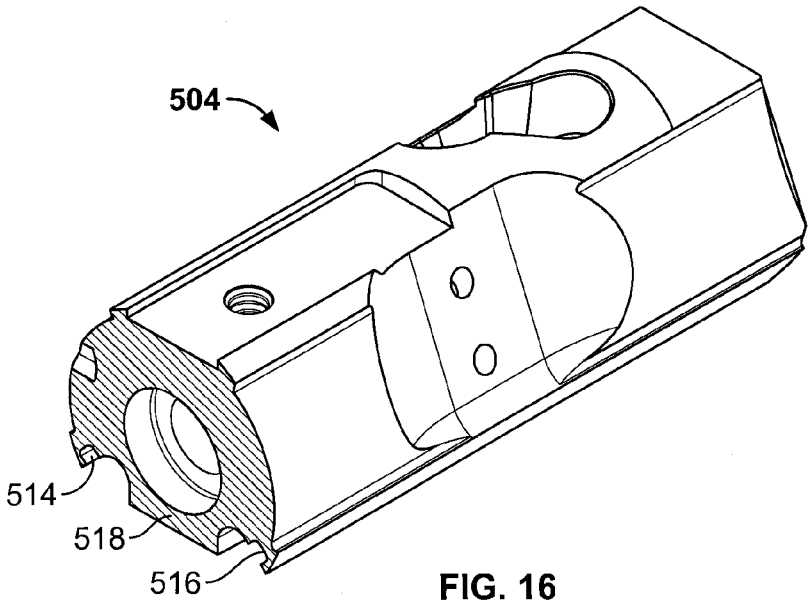
FIG. 16 illustrates a cut-away view of the exemplary bolt carrier of FIG. 15 showing the slots formed in the bolt carrier.
Figure 17:
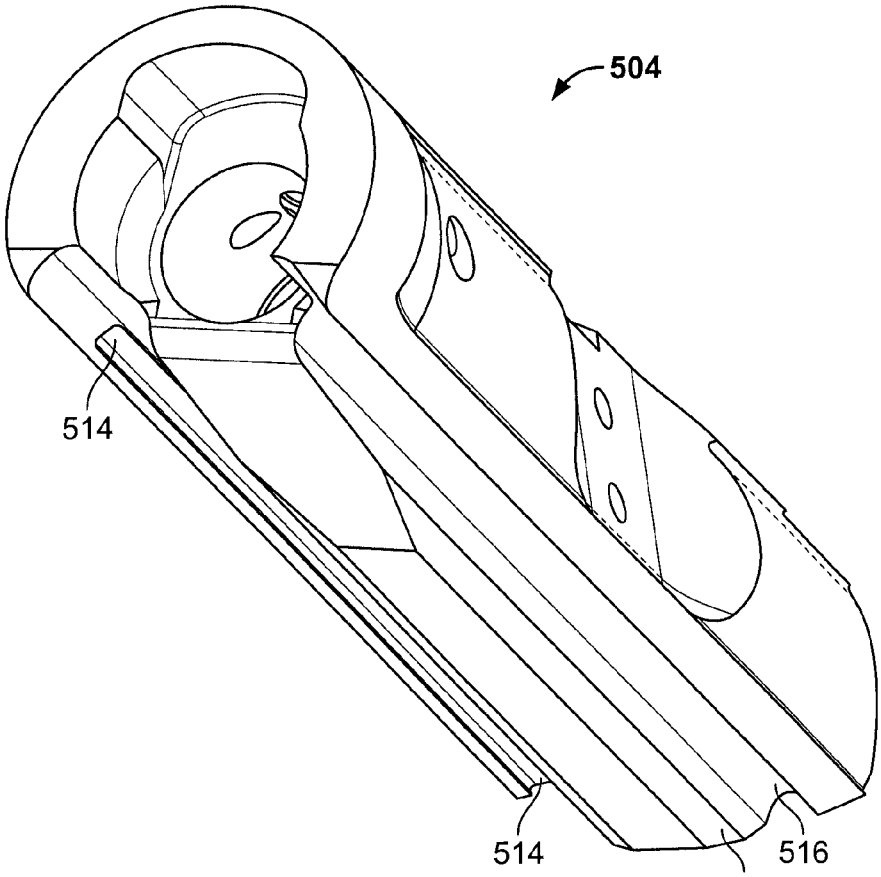
FIG. 17 illustrates an isometric bottom view of the exemplary bolt carrier of FIG. 15.

Referring to FIGS. 15-17, there is depicted an exemplary bolt carrier 504 that may be used with the auto bracket 500. As shown in FIGS. 16-17, the bolt carrier 504 defines elongated slots 514 and 516 formed into opposing sides of the base 518 of the bolt carrier. The slots define an angle and a longitudinal length that permit a certain length of travel of the auto bracket 500 relative to the bolt carrier 504. The guides 556, 558 of the auto bracket 500 operatively engage and slide along the slots 514 and 516 formed in the bolt carrier. The guides 556, 558 may define other shapes and configurations that permit the auto bracket 500 to operatively engage and move relative to the bolt carrier 504.

Figure 18:
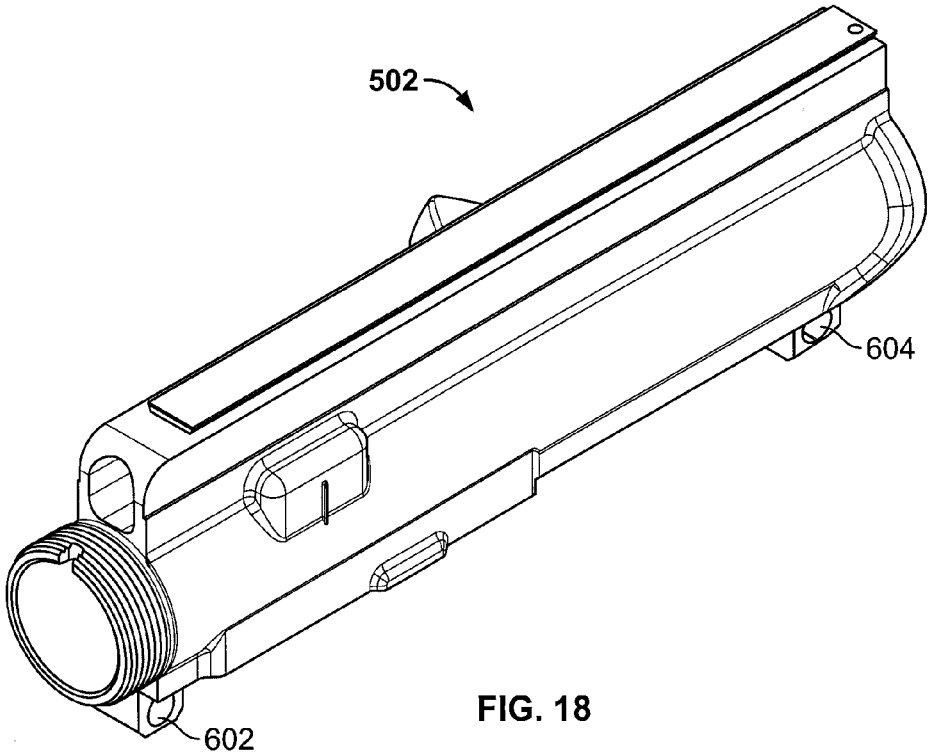
FIG. 18 illustrates an isometric view of an exemplary upper receiver that may be used with the auto bracket of FIG. 12.
Figure 19:
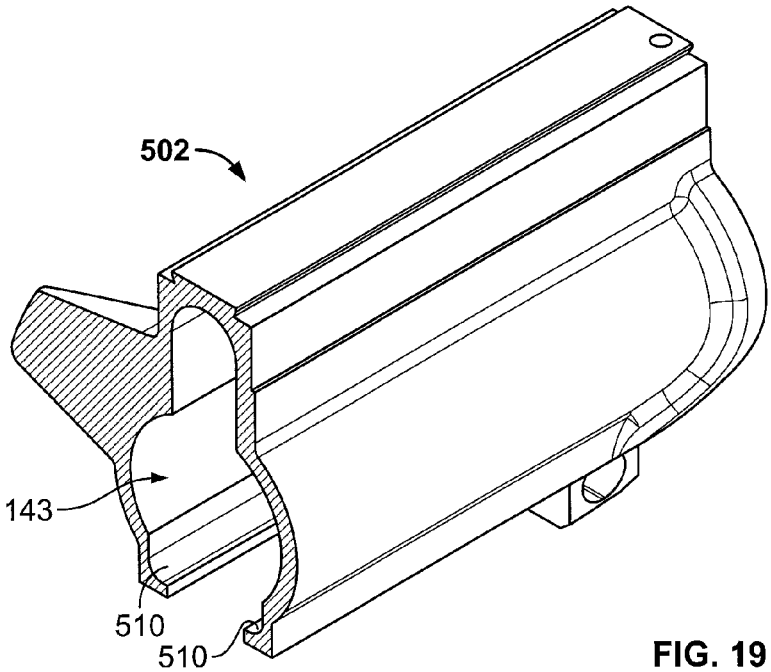
FIG. 19 illustrates a cut-away view of the exemplary upper receiver of FIG. 18 showing the elongated grooves or channels.

Referring to FIGS. 18-19, there is depicted an upper receiver 502 that may be used with the auto bracket 500. The upper receiver 502 includes elongated grooves or channels 510 that are machined on the interior channel 143 of the receiver 502 and configured to operatively receive the guides 532, 534, 542, 544 of the auto bracket. As explained above, the guides 532, 534, 542, 544 cooperate with the grooves or channels 510 formed in the upper receiver 502 to permit the auto bracket to slide along the grooves 510 in the upper receiver. The grooves or channels create a rail or sliding surface for the auto bracket to permit the auto bracket to actuate through the upper receiver 502.

The upper receiver 502 includes a front take-down hole 602 for receiving the pivot pin 96. The upper receiver 502 also includes a rear take-down hole 604 for receiving the take-down pin 112. The pin 96 and pin 112, once removed, permit the upper receiver 502 to be removed from the lower receiver, as understood in the art. The remaining exterior features of the receiver 502 are similar to the upper receiver 7 described above and will not be repeated here.

The auto bracket 500 and bolt carrier 504 are mounted simultaneously into the upper receiver 502. An auto sear 580 which is used with the exemplary embodiment is then aligned with the elongated slot 530 in the auto bracket. The assembly is pinned together with pivot pin 96 and takedown pin 112, which extend through holes 602, 604 in the upper receiver and in openings in the side of the lower receiver to mount the lower receiver to the upper receiver, as described above.

Figure 20:
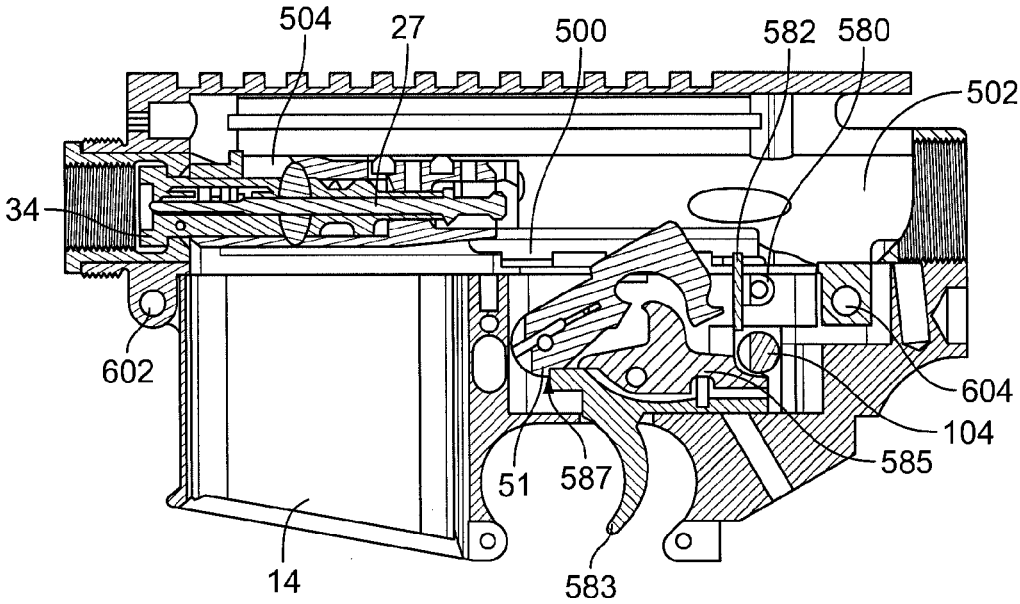
FIG. 20 illustrates a side, partial cross-section view of the exemplary auto bracket mounted to the upper receiver and bolt carrier.

Referring to FIG. 20, there is illustrated the auto bracket 500 mounted to the bolt carrier 504 and the upper receiver 502. FIG. 20 depicts the firearm with the safety selector 104 switched to full-auto position and ready to pull the trigger 583. The auto bracket 500 will ride in the upper receiver 502 along the grooves 510 formed in the upper receiver, as explained above.

Figure 21:
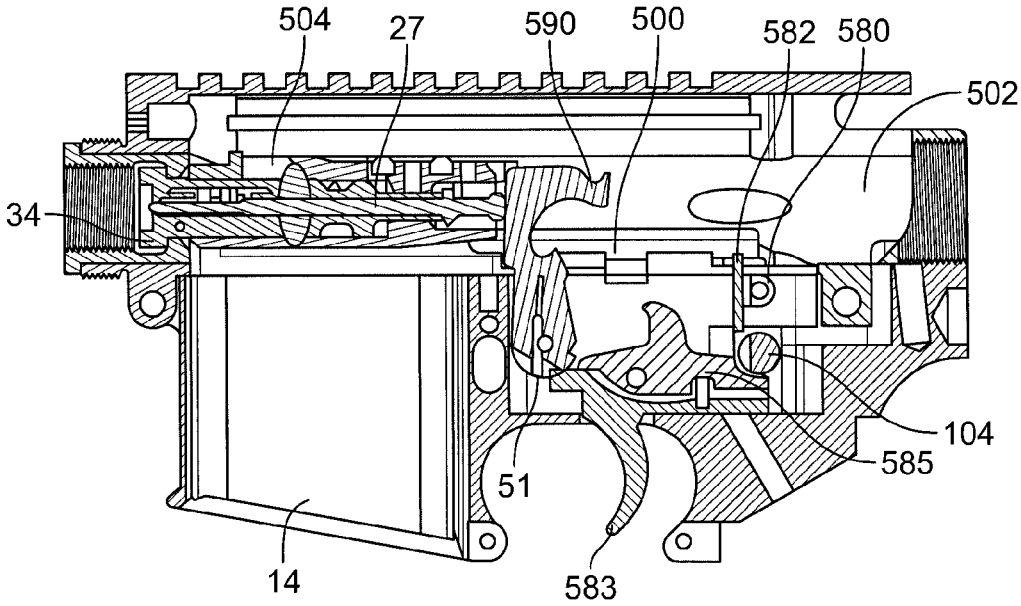
FIG. 21 illustrates a side, partial cross-section view of the exemplary auto bracket mounted to the upper receiver and bolt carrier.

Referring to FIG. 21, when the operator pulls the trigger 583, the hammer 51 is released and hits the firing pin 27. The firing pin, in turn, hits the cartridge causing the round to fire. The disconnector 585 is held in position by the safety selector when the selector is switched to the full-auto position.

Figure 22:
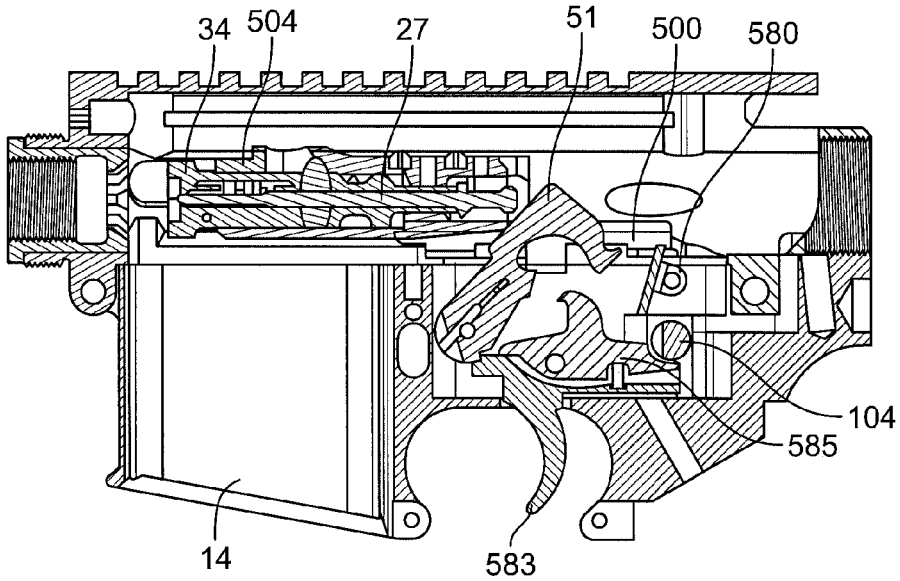
FIG. 22 illustrates a side, partial cross-section view of the exemplary auto bracket mounted to the upper receiver and bolt carrier.

Referring to FIG. 22, the discharged gas from the fired cartridge pushes the bolt carrier group rearward and the bolt carrier pushes the hammer 51 downward and toward the auto sear actuation arm 582. When the bolt carrier moves rearward the contact between the bolt carrier and the auto bracket 500 is gone temporarily. The auto sear 580 spring takes over and pulls the auto bracket 500 rearward vis-à-vis the actuator arm 582 which operatively contacts the bracket 500 through the elongated aperture 530, to reset the auto bracket 500.

Figure 23:
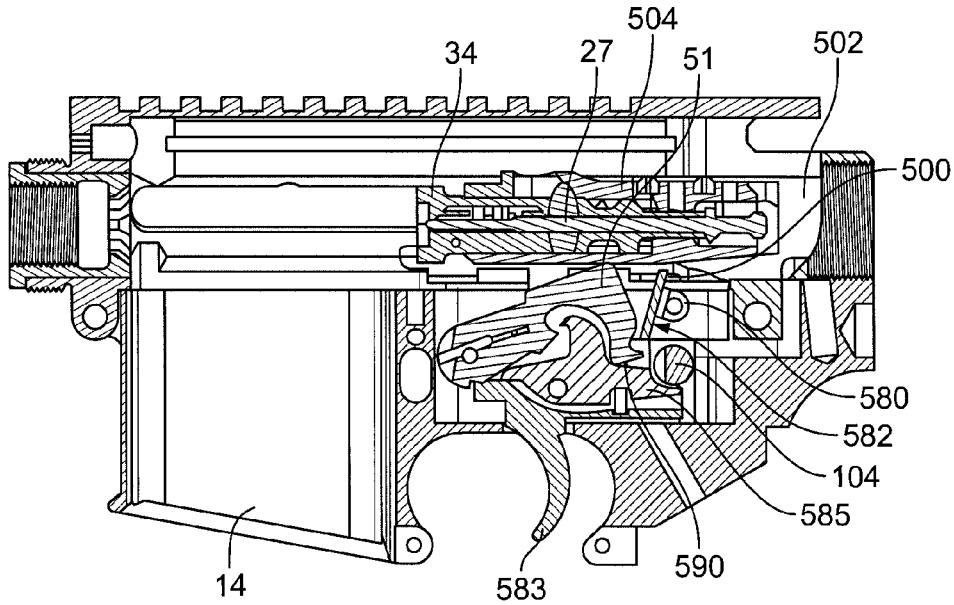
FIG. 23 illustrates a side, partial cross-section view of the exemplary auto bracket mounted to the upper receiver and bolt carrier.
Figure 24:
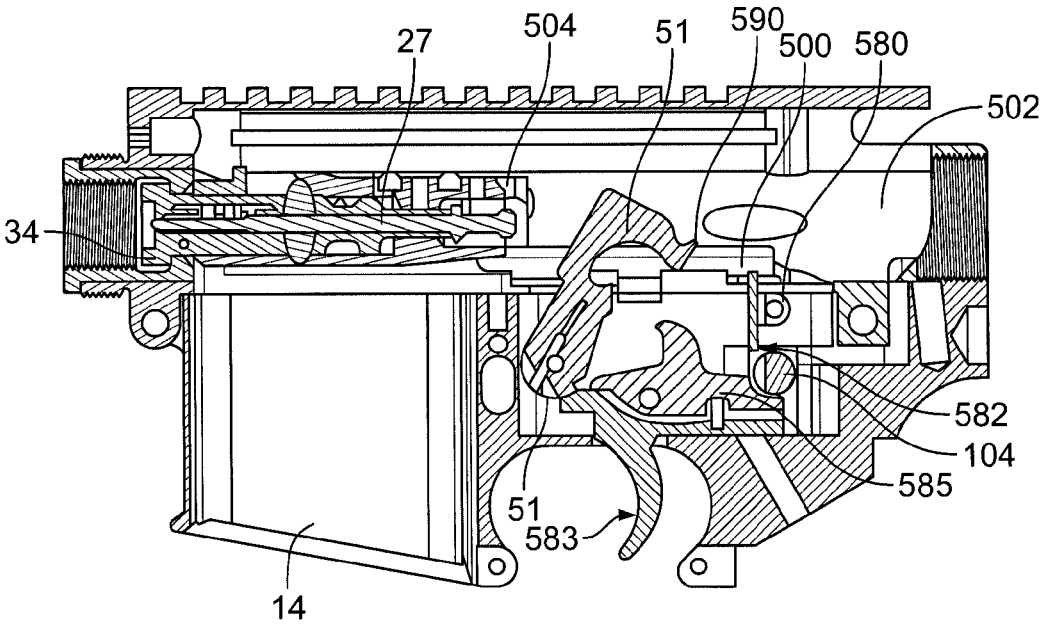
FIG. 24 illustrates a side, partial cross-section view of the exemplary auto bracket mounted to the upper receiver and bolt carrier.
Figure 25:
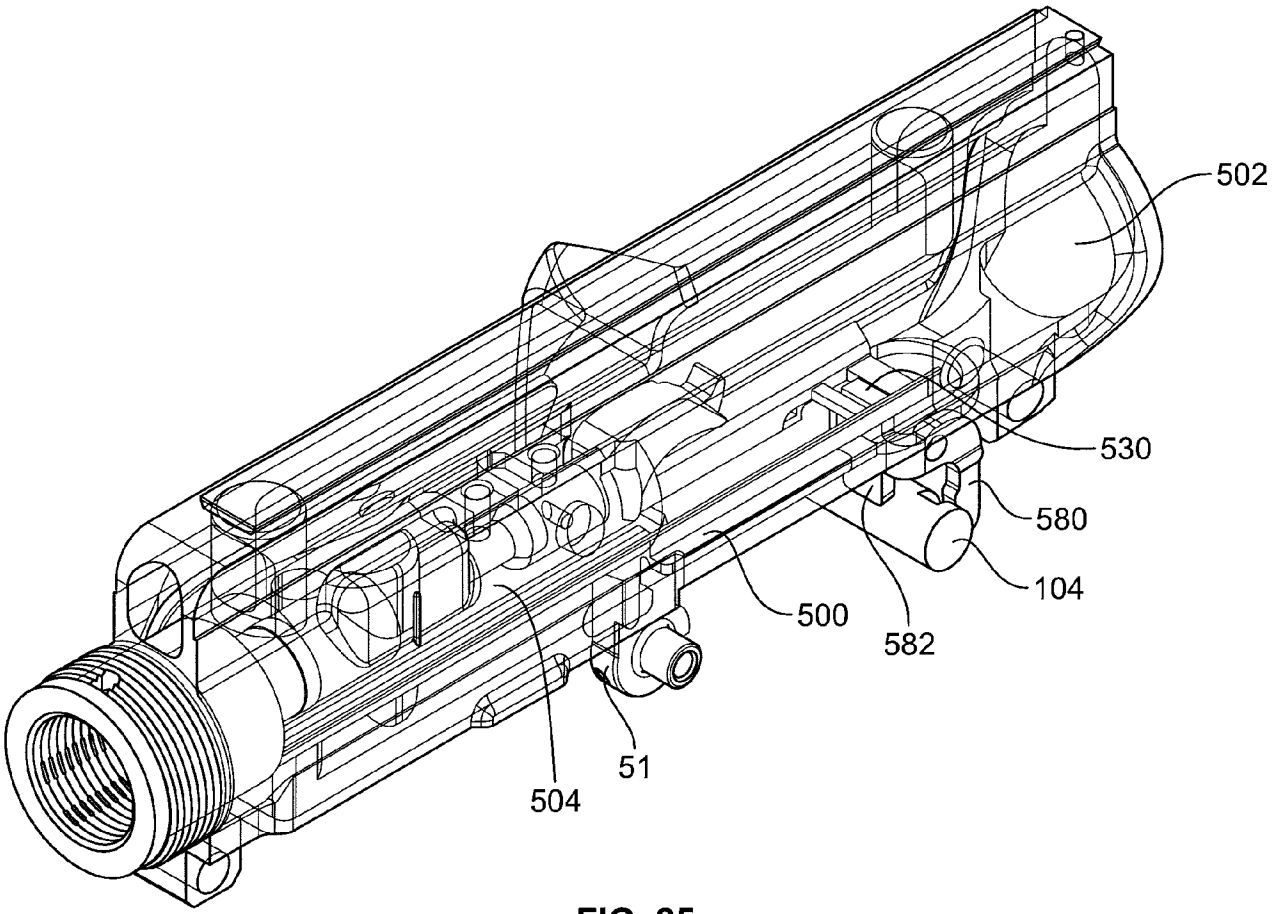
FIG. 25 illustrates an isometric view of an exemplary auto bracket mounted to the upper receiver and bolt carrier.

Referring to FIG. 23, the bolt carrier 504 contacts the hammer 51 pushing it downward. When the bolt carrier begins to move forward, the hammer 51 moves upward and the hook 590 rests on the auto sear arm 582. After the bolt carrier rebounds forward to pick up the next round from the magazine, the bolt carrier catches the auto bracket end guides 556, 558, in the extended position pulling the auto bracket 500 forward a sufficient distance to disengage the auto sear actuation arm 582 from the hammer 51, as shown in FIG. 24 and shown moving the auto sear actuation arm from an angular position to a vertical or upright position. This action releases the hammer 51 in a timed manner causing the hammer to contact the firing pin 27 which in turn fires the next cartridge, thereby causing the firearm to run in automatic mode. After the first trigger pull, the auto sear arm 582 becomes the resting point for the hammer until the operator releases the trigger. This operation cycle continues until the operator releases the trigger. Once the trigger is released, the operation cycle described above resets.

It is to be understood that the invention is not limited in its application to the details of construction and the arrangement of the components set forth herein and illustrated in the drawings. The invention is capable of other embodiments and of being practiced or being carried out in various ways. Variations and modifications of the foregoing are within the scope of the present invention. It should be understood that the invention disclosed and defined herein extends to all alternative combinations of two or more of the individual features mentioned or evident from the text and/or drawings. All of these different combinations constitute various alternative aspects of the present invention.

What is claimed is:

1. A firearm comprising:

a lower receiver, an upper receiver mounted to the lower receiver, a barrel mounted to the upper receiver, a handguard surrounding at least part of the barrel, an elongated mounting rail positioned above the upper receiver, a gas piston housing mounted to the elongated rail and positioned forward of the upper receiver, a piston and rod assembly operatively mounted to the gas piston housing and above the barrel, the piston and rod assembly operatively connected to a bolt carrier disposed in the upper receiver, a trigger assembly, the trigger assembly including a trigger and a hammer, an auto sear, wherein the auto sear operatively contacts the hammer, and an auto bracket slidably mounted to the upper receiver and to the bolt carrier, the auto bracket defining opposing rails connected by a transversely extending support bracket and an opening in the support bracket for receiving and contacting the auto sear.

2. The firearm of claim 1, further comprising an adjustable gas regulator mounted to the gas piston housing.

3. The firearm of claim 2, further comprising a gas plug screw mounted to the gas piston housing.

4. The firearm of claim 2, wherein the auto bracket defines a pair of rails joined by a bracket, a first pair of guides extending from the rails for mounting to the upper receiver, and a second pair of guides extending from the rails for mounting to the bolt carrier.

5. The firearm of claim 1, wherein the rails include opposing guides extending outwardly from the rails.

6. The firearm of claim 5, wherein the upper receiver defines at least one elongated groove for receiving at least one of the guides.

7. The firearm of claim 5, wherein the bolt carrier defines at least one elongated slot for receiving at least one of the guides.

8. The firearm of claim 1, wherein the auto bracket defines a pair of rails joined by a transversely extending bracket, a first pair of guides extending from the rails, and a second pair of guides extending from the rails.

9. The firearm of claim 8, wherein the first pair of guides slidably engages the upper receiver and the second pair of guides slidably engages the bolt carrier.

10. The firearm of claim 8, wherein the second pair of guides defines an end stop.

11. The firearm of claim 8, further comprising a pistol grip mounted to the lower receiver.

12. The firearm of claim 1, further comprising a guide rod base mounted to an end of the rod.

13. The firearm of claim 1, further comprising a flash hider mounted to an end of the barrel.

14. The firearm of claim 1, wherein the mounting rail is configured to mount firearm accessories, including lights and optics.

15. The firearm of claim 1, further comprising a charging handle that includes foldable ears.

16. The firearm of claim 15, wherein the charging handle is non-reciprocating.

17. A firearm comprising:

a lower receiver, an upper receiver mounted to the lower receiver, a barrel mounted to the upper receiver, a handguard surrounding at least part of the barrel, an elongated mounting rail positioned above the upper receiver, a trigger assembly, the trigger assembly including a trigger and a hammer, an auto sear, wherein the auto sear operatively contacts the hammer, and an auto bracket slidably mounted to the upper receiver and to a bolt carrier, the auto bracket defining opposing rails connected by a transversely extending support bracket and an opening in the support bracket for receiving and contacting the auto sear.

18. The firearm of claim 17, wherein the rails include a plurality of guides extending outwardly from the rails.

19. The firearm of claim 18, wherein the upper receiver defines at least one elongated groove for receiving at least one of the guides.

20. The firearm of claim 19, wherein the bolt carrier defines at least one elongated slot for receiving at least one of the guides.

21. The firearm of claim 17, wherein the rails include a first pair of guides extending from the rails, and a second pair of guides extending from the rails.

22. The firearm of claim 21, wherein the first pair of guides slidably engages the upper receiver and the second pair of guides slidably engages the bolt carrier.

23. A firearm comprising:

a lower receiver, an upper receiver mounted to the lower receiver, a barrel mounted to the upper receiver, a handguard surrounding at least part of the barrel, an elongated mounting rail positioned above the upper receiver, a trigger assembly, the trigger assembly including a trigger and a hammer, an auto sear, wherein the auto sear operatively contacts the hammer, and an auto bracket slidably mounted to the upper receiver and to a bolt carrier, the auto bracket defining a pair of rails joined by a transversely extending support bracket, a first pair of guides extending from the rails, and a second pair of guides extending from the rails, and the auto bracket for receiving and contacting the auto sear.

24. The firearm of claim 23, wherein the first pair of guides slidably engages the upper receiver and the second pair of guides slidably engages the bolt carrier.

* * * * *